US005431219A

United States Patent [19]

Leising et al.

[11] Patent Number: 5,431,219

[45] Date of Patent: Jul. 11, 1995

[54] FORMING CASING WINDOW OFF WHIPSTOCK SET IN CEMENT PLUG

[75] Inventors: Larry J. Leising, Sugar Land, Tex.; Mansour S. Shaheen, Gaza Strip, Israel; Denis Doremus, Houston, Tex.

[73] Assignee: Dowell, a division of Schlumberger Technology Corp., Houston, Tex.

[21] Appl. No.: 266,016

[22] Filed: Jun. 27, 1994

[51] Int. Cl.[6] ..... E03B 3/11

[52] U.S. Cl. ..... 166/50; 166/117.5

[58] Field of Search ..... 166/50, 55.1, 55.8, 166/117.5, 298, 384

[56] References Cited

U.S. PATENT DOCUMENTS

| | | | |
|---|---|---|---|
| 2,173,035 | 9/1939 | Armentrout et al. | 175/61 X |
| 2,632,630 | 3/1953 | Storm | 166/117.5 |
| 2,691,507 | 10/1954 | Brown | 166/117.5 |
| 3,289,760 | 12/1966 | Kammerer | 166/55.8 X |
| 4,100,528 | 7/1978 | Bernard et al. | 367/83 |
| 4,103,281 | 7/1978 | Strom et al. | 367/83 |
| 4,167,000 | 9/1979 | Bernard et al. | 367/84 |
| 5,052,502 | 10/1991 | Jurgens et al. | 175/80 |
| 5,311,952 | 5/1994 | Eddison et al. | 175/61 |

*Primary Examiner*—Roger J. Schoeppel

*Attorney, Agent, or Firm*—Henry N. Garrana; John H. Bouchard; John E. Vick, Jr.

[57] ABSTRACT

Methods and systems for forming a window through the wall of a well casing to enable a new borehole to be drilled outside the casing include forming a cement plug in the casing, drilling a laterally offset hole in the cement plug, orienting and setting a whipstock in the offset hole, and using the whipstock to drill an elongated window through the casing wall opposite its deflector surface. The drilling steps employ a mud motor having a bent housing that establishes a toolface for the bit, and proper orientation is obtained by downhole measurement and transmission to the surface of orientation signals and downhole adjustment of orientation to a selected toolface value. The whipstock is oriented in the same manner. All drilling and orientation procedures are carried out on coiled tubing to reduce costs.

22 Claims, 2 Drawing Sheets

FORMING CASING WINDOW OFF WHIPSTOCK SET IN CEMENT PLUG

FIELD OF THE INVENTION

This invention relates generally to methods and systems for forming a downhole window in the wall of a casing which allows a new borehole to be drilled outside the casing, and particularly to methods and systems where a whipstock is oriented and set in a laterally offset hole drilled in a cement plug to enable the window to be milled through the casing wall opposite the deflector surface of such whipstock.

BACKGROUND OF THE INVENTION

Whipstocks have been used for many years in connection with the drilling of boreholes that sidetrack or extend outward from an existing borehole. Although the existing borehole might not be lined with casing (open-hole), typically the hole has been cased so that an elongated window must be milled through the wall of the steel casing to enable a drill bit and string to pass to the outside, In order to form the window, a device known generally as a whipstock is anchored against downward and rotational movement in the casing. A whipstock is primarily an elongated metal cam or wedge having an inclined, concave deflection surface that guides a rotary milling cutter on a drill string while forcing progressive outward movement thereof. The downward and outward movement of the milling cutter, as it is rotated by the drill string, forms an elongated window through the wall of the casing. If desired, a pilot mill can be used first to start the milling cut and/or mill the lug, and then a window mill used to complete the opening. In some cases a so-called "watermelon" mill can be run in tandem or separately from the window mill to ream and finish the edges of the window and ensure that drilling tools run later on will not catch or otherwise hang up in the window. In any event the window permits a drill bit and string, or a drill bit, mud motor and running string, to be advanced therethrough so that a new borehole can be drilled outside the casing.

In many well installations a production string of tubing extends from the surface down inside the larger diameter casing in which a window needs to be formed. A packer usually is positioned near the lower end of the production string to isolate the well bore below the packer from the annulus above it. To remove the packer and the production string from the well, and then reinstall these later, are time consuming and expensive operations which operators seek to avoid where possible. However prior whipstock procedures have necessitated removal of the production string and packer without regard to expense.

An object of this invention is to provide new and improved methods for forming a window in the casing below a production string.

Another object of the present invention is to provide new and improved methods and systems for orienting and setting a whipstock in a laterally offset manner in a casing cement plug below a production string to enable a window to be formed in the casing opposite the deflection face of the whipstock.

SUMMARY OF THE INVENTION

These as well as other objects are attained in accordance with the present invention through the provision of unique methods including the steps of forming an elongated cement plug in the well casing below the lower end of the production string, using a mud motor having a bent housing to drill a bore in the cement plug which includes a lower section that is laterally offset and next to or adjacent an inner wall of the casing, orienting and setting a whipstock in such lower section so that its deflection surface faces said inner wall, and then using one or more milling cutters driven by a mud motor to form a window through such inner wall so that a new borehole can be drilled outside the casing. It is preferable that downhole measurements be made and telemetered to the surface from which the azimuthal direction of the bit axis or the deflector surface can be determined, and that a downhole means be provided to properly orient the tools. The present invention also includes unique systems or combination of tools or components to practice the above methods.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DETAILED DESCRIPTION OF PREFERRED EMBODIMENTS

Figures 1, 2:
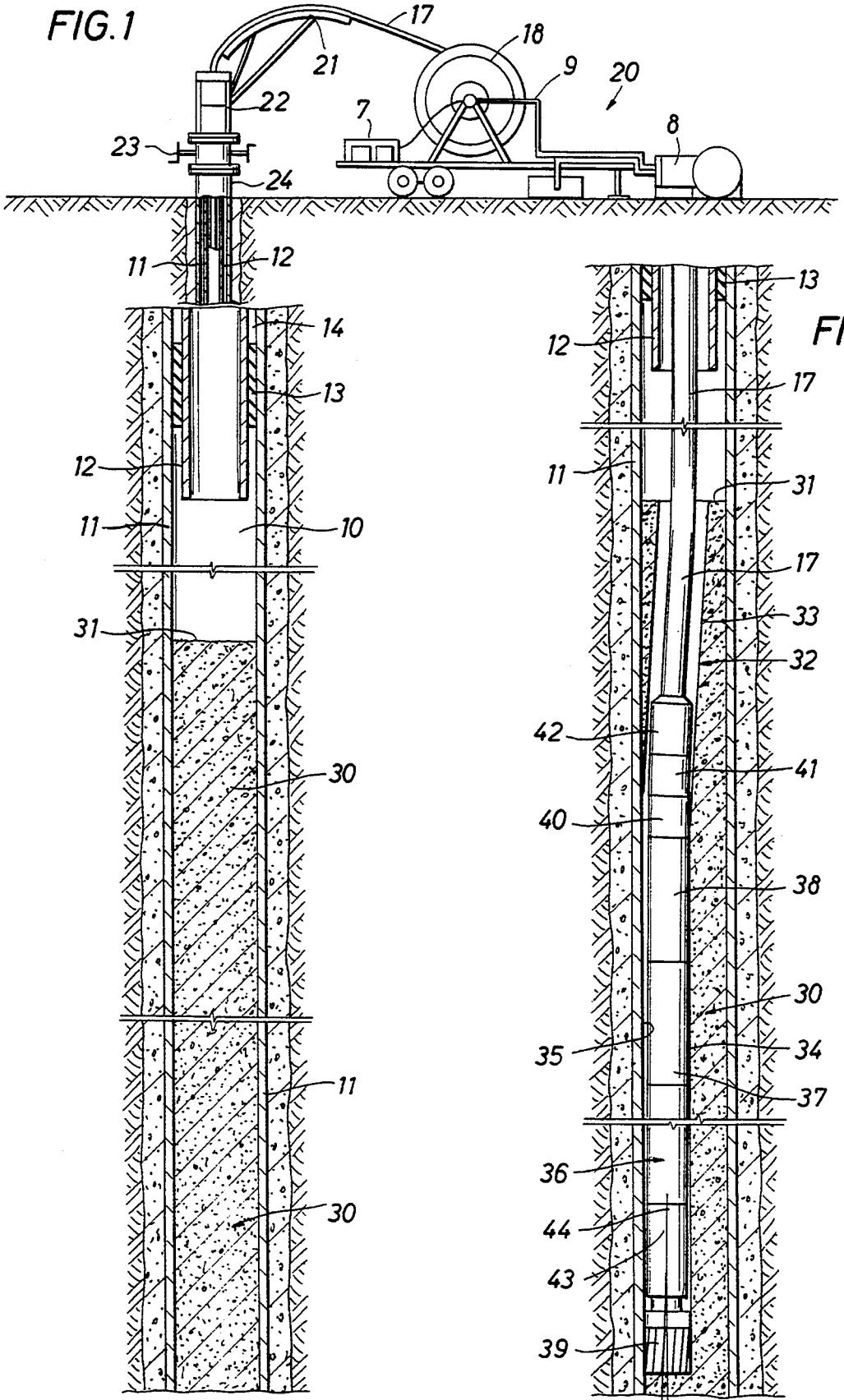
FIG. 1 is a schematic view of a cased well installation showing a cement plug set below the productive pipe.
FIG. 2 is a view similar to FIG. 1 and showing the laterally offset bore section being drilled in the cement plug.

Referring initially to FIG. 1, a well bore 10 is shown lined with steel casing 11 that has been cemented in place per usual practice. Although the wellbore 10 appears in the drawings to extend virtually downward, in actuality it will be recognized that much of the lower portion of the wellbore is inclined with respect to vertical on account of modern drilling and completion practices. Being inclined, the wellbore 10 has what typically is referred to as a low side and a high side. A production string of pipe 12 is suspended in the casing 11 from a wellhead 24 at the surface, and a production packer 13 of conventional construction isolates the pressure and fluids in the well bore 10 from the annulus 14 above the packer. By way of example for purposes of this description, the production pipe 12 can have an outer diameter of about inches, and the casing 11 can have an outer diameter of 7 inches. Although a running string of conventional pipe or tubing having joints threaded end-to-end could be used in the practice of the present invention, it is preferable to use a continuous length of coiled tubing 17 that is wound on the reel 18 of a mobile surface unit 20. The coiled tubing 17, which can have, for example, a diameter of about 3 inches, passes over a guide 21 and into the top of an injector 22 that forces it down into and out of the production tubing 12 under power. The tubing 17 goes through one or more blowout preventers 23 that are mounted on top of the wellhead 24. The inner end of the coiled tubing 17 is connected by couplings and a pipe 9 to a mud pump 8 so that fluids can be circulated down the tubing for purposes to be described below. A downhole measurement display unit 7 can be connected either to a pressure transducer at the coupling for the acquisition of data in the form of modulated pressure pulses in the fluids inside the tubing 17, or via suitable electrical connectors to a wireline cable that extends throughout the length of the coiled tubing. Since the coiled tubing 17 is continuous throughout its length, the need to make up and break out numerous threaded joints is eliminated, with considerable savings in time and expense.

Whether by reason of the need to sidetrack junk in the casing 11, or the need to form a new borehole that extends outward of the casing to a particular target, a window must be formed through the wall of the casing 11 below the production tubing 12 to allow drilling tools to pass therethrough. In accordance with the present invention, a first step in the process is to form an elongated cement plug 30 in the casing 11 by running a work string of tubing (not shown) down through the production pipe 12 until the lower end of such string is near where the lower end of the cement column should be, and then pumping cement slurry down the work string while gradually raising the same at the surface. After a predetermined number of barrels of cement have been pumped down to provide for a desired length of the plug 30, the work string is withdrawn to allow the cement to harden and cure. In a typical case, the cement plug 30 should be about 50–150 feet long and top out at 31 about 5-10 feet below the bottom end of the production pipe 12. However the cement could extend to the bottom end of the pipe 12, and then up into the bore thereof for a number of feet.

The next step in the process is to drill a bore 32 in the cement plug 30 as shown in FIG. 2. The bore 32 is formed with an upper section 33 which curves downward and outward to the top of a lower section 34 that extends straight along and adjacent the inner wall 35 of the casing 11. The bore 32 is drilled using a mud motor 36 having a mill 39 on its lower end. The upper end of the motor 36 is attached to a measuring-while-drilling (MWD) tool 37 which is attached to an orienting device 38. Above the device 38 is a disconnect sub 40, an upwardly closing check valve 41, and a coiled tubing connector 42 which attaches to the lower end of the coiled tubing 17. The components 40–42 are standard and well known in this art. The mud motor 36 preferably is a Moineau-type device where a helical rotor turns within a lobed stator in response to the flow drilling fluid pumped down the coiled tubing 17, and has a bent housing 43 which provides a bend point 44 near its lower end. The bend angle 0 causes the axis of rotation of the mill 39 to intersect the longitudinal axis of the motor 37 at a low angle, for example about 0.38 degrees in this application. This construction causes the bit 39 to drill the curved section 33 in the upper portion of the cement plug 38 until the bit engages the inner wall 35 of the casing 12. Then the bit 39 will drill straight ahead throughout the bore section 34 since the casing wall prevents further outward movement of the mill 39. A stabilizer (not shown) having several radial ribs that tend to center the bent housing 43 in the hole 32 can be mounted on the bend housing.

The MWD tool 37 and the orienting tool 38 are used prior to starting the drilling of the offset bore 32 to orient the azimuthal direction of the axis of rotation of the bit 37 (toolface) in a manner such that the lower hole section 34 will be drilled along that side of the casing 11 where the window is to be formed. As noted above, although the drawing figures depict the well bore 10 as extending vertically downward, in actuality it extends at an angle to the vertical so that it has a low side and a high side. The MWD tool 37 includes an inclinometer in the form of a set of orthogonally mounted accelerometers which measure components of the earths gravity field and provides output signals that can be combined to provide the inclination and toolface angles. As used in connection with this disclosure, "toolface angle" or simply "toolface" means the angle, expressed as a positive or negative value between 0° and 180°, between a line that is the radial component of the axis of rotation of the drill bit and a reference radial line which extends through the lowermost side of an inclined borehole. Toolface typically is shown on a special surface display which is a graduated circle with the top of the circle having the 0° indicia, and the bottom is marked 180°. The upper right quadrant is graduated from 0° to +90°, and the lower right quadrant from +90°to 180°. The left upper and lower quadrants are marked the same way except the degrees have negative values. Thus, if the downhole measurements of the inclinometer cause the radial marker on the display to indicate a toolface of +45°, for example, the borehole is curving to the right and that the inclination of the borehole is gradually increasing or building up. But if the marker indicates −120°, for example, the borehole is curving to the left and the inclination is dropping or decreasing toward the vertical.

Where mud pulse telemetry is employed, the signals from the inclination sensors are fed to a controller which modulates the rotational speed of a rotary valve element or "siven" that interrupts the mud flowing down the coiled tubing 17 to provide pressure pulses. The pulses travel very quickly to the surface where they are detected, processed and displayed or recorded so that inclination angle and toolface are available substantially in real time. A mud pulse telemetry system is disclosed in U.S. Pat. Nos. 4,100,528, 4,103,281 and 4,167,000 which are incorporated herein by reference. As noted above, a wireline MWD tool also can be used which converts the analog inclinometer signals to digital and transmits them to the surface over an electric wireline or cable that extends through the bore of the coiled tubing 17. At the surface the signals are processed and converted back to analog values for display.

In order to rotationally orient the drilling motor 36 so that the toolface angle of the drilling cutter 39 has a selected value, an orienting tool 38 of the type disclosed and claimed in U.S. Pat. No. 5,311,952 includes a spring-loaded mandrel with a flow restriction in its bore so that temporarily reducing and then increasing the mud flow rate causes respective upward and downward movement of the mandrel. Such movement operates an automatic index system of inclined channels and lugs which rotate a lower housing connected to the MWD tool 37 through a predetermined angle such a 30° or 45° or other angle depending upon the angular spacing of the channels. The MWD tool 37 is referenced during assembly to the toolface provided by the bent housing, so that the mud pulse or electrical telemetry signals can be processed to show the azimuthal direction in which the mill cutter 39 will drill. The '952 patent also is incorporated herein by reference.

In practice the cutter 39, which is turned to the right or clockwise by the motor 36 as viewed from above, tends to "walk" in a counterclockwise direction, as the straight section 34 of the hole 32 is drilled. This is because the outer side of the mill 39 is rotating clockwise against the inner wall 35 of the casing 11 and thus tends to drill gradually in the opposite hand direction as the hole 34 is deepened. To compensate for such walking tendency, the toolface angle of the cutter 39 initially is over corrected by a selected amount. An initial correction also is made for the wind-up angle in the coiled tubing 17 due to the reactive torque on the bent housing 43 which is a function of the amount of weight-on-bit. When properly connected, an equilibrium will be established once the drilling begins which will maintain the desired toolface angle. With the proper toolface established by operating the orienting tool 38, as confirmed by the MWD tool 37, the hole section 34 is drilled to a selected length as shown in FIG. 2. The drilling tool assembly then is pulled out of the well by operating the injector 22 and the reel 18.

Figure 3:
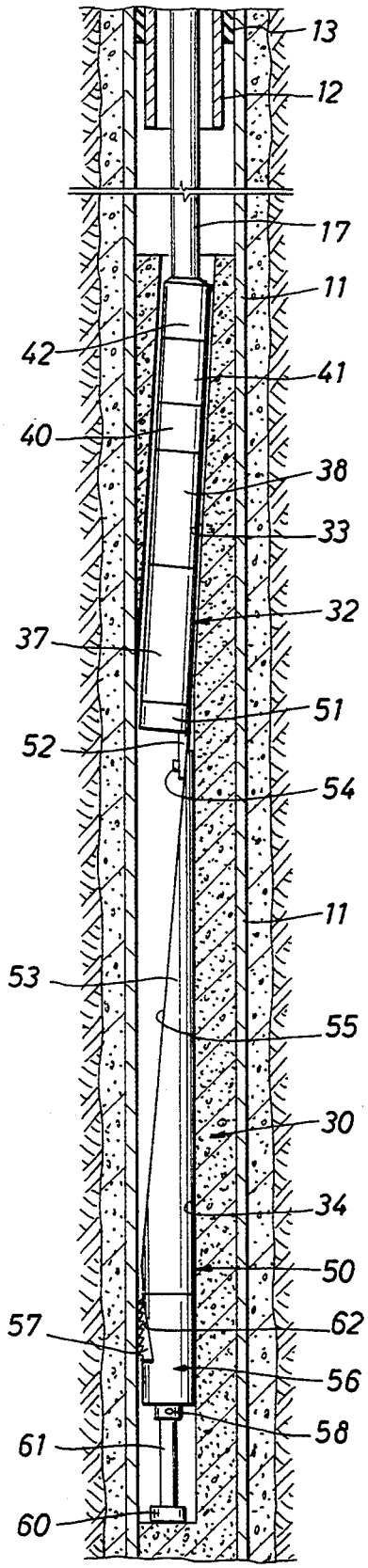
FIG. 3 is another schematic view showing a whipstock set in such bore section.

A combination anchor 56 and whipstock 50 then is run down through the production pipe 12 on the lower end of the coiled tubing 17 as shown in FIG. 3. The whipstock 50 is suspended from the MWD tool 37 by a collar 51 having a depending leg 52 that is releasably secured to the top of the deflector guide body 53 by a shear stud 54 or the like. The components above the MWD tool 37 are the same ones shown as elements 38 and 40–42 in FIG. 2. The body 53 has a downward and outward by inclined surface 55 that is concave in transverse crosssection to guide the bit 39 longitudinally while forcing it gradually outward during downward movement. The lower end of the body 53 is threaded to an anchor assembly 56 that carries a normally retracted slip member 57. A coil spring that is held compressed by a shear pin 58 is released by shearing of the pin when a foot 60 on the lower end of a rod 61 engages the bottom surface of the hole 34 as shown. Expansion of the spring causes the slip member 57 to shift upward and outward along inclined surface 62 until teeth on the outer periphery of the slip member engage and bite into the adjacent inner wall surface of the casing 11. Of course the anchor assembly 56 and the whipstock 50 could be connected together so that the slip member 57 anchors against the cement. The slip teeth face downward and thus grip even more tightly in response to downward force on the deflector body 53. Although a combination whipstock and anchor assembly is disclosed herein, an anchor could be run, oriented and set, followed by the running of a whipstock that is guided into support with the anchor in a known manner.

Prior to running the whipstock 50 into the bore 32, the deflector surface 55 is properly oriented by operating the orienting tool 38 as described above while transmitting inclinometer signals to the surface with the MWD tool 37. When the desired orientation is achieved, the whipstock 50 and anchor 56 are lowered into the bore 32. When the foot 60 rests on the bottom of the bore, weight is applied to consecutively shear the pin 58 and the stud 54. Then all tools above the whipstock 50 are withdrawn from the well as the coil tubing 17 is wound back onto the reel 18.

Figure 4:
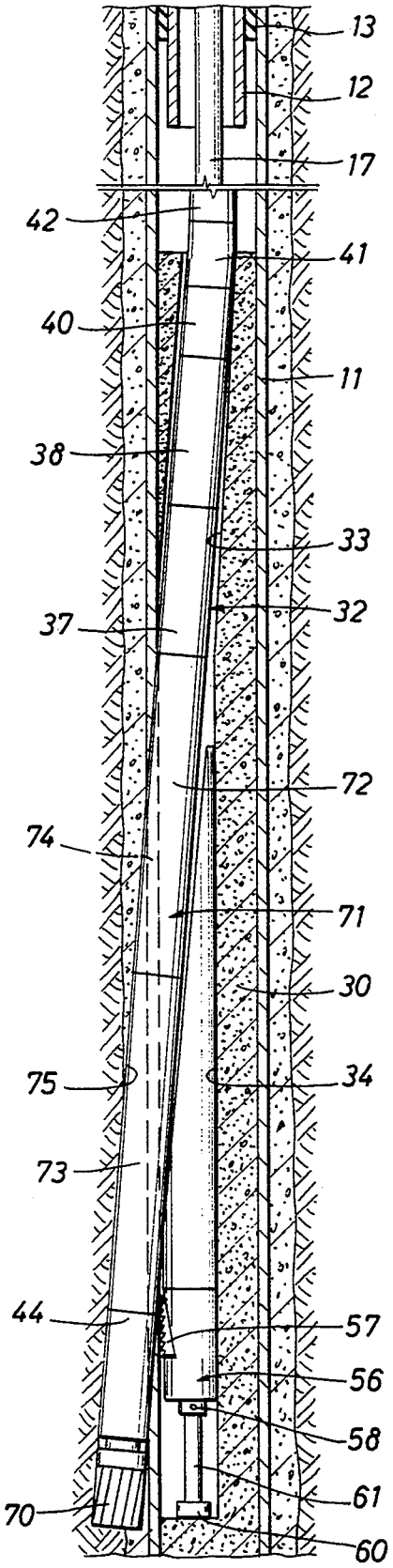
FIG. 4 is a schematic view illustrating a window cut through the wall of the casing opposite the whipstock by a mill driven by a mud motor.

To form a window through the side of the casing 11 so that a new borehole can be drilled outside it, the string of drilling tools shown in FIG. 4 is run on the coiled tubing 17. The tool string includes a speed mill 70 driven by a mud motor 71 having a power section 72 and a housing 73. The housing 73 preferably provides a bend angle, however a straight housing could be used. As in FIGS. 2 and 3, an MWD tool 37 and an orienting tool 38 are connected above the mud motor 71, and the various check valve, release and connector components 40–42 also are used. Prior to lowering the mill 70 into the upper end of bore 32, the orientation tool 38 and the MWD tool 37 are operated as described above to orient the toolface of the mill 70 with respect to the low side of the hole at the same angle as a radial line perpendicular to the deflection surface 55 would have with respect to such low side. Then the bit 70 is lowered into engagement with the upper end of the deflector surface 55 and the motor 71 is operated to initiate mill-out of a window 74 through the wall of the casing 11. As the mill 70 opens an elongated window, it is forced progressively outward by the deflector surface 55 until it has cut the window completely and has passed through the cement sheath outside as shown. Eventually the new borehole 75 will extend entirely outside the casing 11. It is preferred to continue the drilling until the hole 75 extends some 5–15 feet outside the casing 11. The drill tool string then is removed from the well. If desired, other type mills can be substituted for the speed mill 70 and the drilling tools rerun to redress the window 74 by removing any burrs or projections. Finally another and perhaps more powerful drilling motor and a rolling cutter or diamond drill bit is run through the window 74 to lengthen the new hole 75 and drill it directionally to a particular target.

OPERATION

In operation and use of the present invention, a casing collar locator (CCL) and gamma ray logging tool should be run on electric wireline to precisely define the kick-off depth, which preferably should be from 10 feet below a collar in the casing 11 to about 20 feet above a collar therein. Then the cement plug 30 is formed as described above to extend from at least about 50 feet below the kick-off depth to a few feet below the lower end of the production pipe 12. Of course the overall length of the cement plug 30 is a matter of prudent design. The cement plug 30 is allowed to harden and cure for an appropriate length of time.

Then a drilling tool string including the 3¾ inch speed mill 39, a 2⅞ inch mud motor 36 with a 0.38° bent housing 43, an MWD steering tool 37, an orienting tool 38, several 2⅞ inch drill collars, a disconnect 40, a check valve 41 and a coiled tubing connector 42 is run in on the coiled tubing 17 until the speed mill is just above the top of the plug 30. The mud pumps are started to initiate circulation and allow operation of the MWD tool 37 and the orienting tool 38. The mud flow rate is cycled by reducing same and then increasing it back to a normal level until the motor 36 and the bent housing 43 has been angularly indexed such that the toolface has the desired angle plus any "walk" correction angle and wind-up angle that is needed. Such orientation can be with respect to the low side of the casing 11 which, as noted above, is inclined at some angle to the vertical. Then the bit 39 is lowered and weight applied thereto to cause the curved upper section 33 of the hole 32 in the cement plug 30 to be drilled until the bit comes out against the inner side wall 35 of the casing 11. When this occurs the bit 37 will drill straight ahead along the inner wall 35 until the hole has been lengthened an appropriate distance as shown in FIG. 2. Then this drilling tool string is pulled out of the well.

The next step in the operation is to run a 3½ inch whipstock 50 having a 1.12° concave deflection surface 55 and the anchor assembly 56 below the MWD tool 37 and the orienting tool 38. The usual components 41–42 suspend the whipstock 50 and anchor 56 on the lower end of the coiled tubing 17. The collar 51, leg 52 and shear stud 54 provide a releasable connection. The string is halted several feet before the anchor foot 60 reaches the bottom of the hole 32. Fluid circulation is initiated so that the angular orientation of the whipstock face 55 can be set by operation of the orienting tool 38 as signals are telemetered uphole by the MWD tool 37. When the whipstock 50 is satisfactorily positioned, the tool string is lowered to bottom and weight imposed to shear the pin 58 and set the slip member 57 as shown in FIG. 3. Additional weight causes shearing of the stud 54 to release the whipstock 50 from the components thereabove. Such components then are retrieved to the surface as the coiled tubing 17 is wound back onto the reel 8.

To form the window 74 so that a new borehole 75 can be drilled outside the casing 11, the drilling tool string shown in FIG. 4 is run on the coiled tubing 17. This string includes a $3\frac{3}{4}$ inch speed mill 70, which can be followed in tandem by a $3\frac{3}{4}$ inch "watermelon" mill if desired, a $2\frac{7}{8}$ inch mud motor 71 with a 0.38° bent housing 73, a pressure pulse or wireline MWD tool 37, an orientation tool 38, and the components 40–42 noted above. When the mill 70 reaches the top of the hole 32 in the cement plug 30, the string is halted and the mud pump 8 started to operate the MWD tool 37 and allows orientation of the toolface of the mill 70 to the proper value. Then the string is lowered until the mill 70 engages the top of the deflector surface 55. Weight is imposed on the mill to cause it to advance downward along the surface 55 as it gradually opens the elongated window 74 opposite the surface 55 as shown in FIG. 4. Near the lower end of the deflector surface 55 the mill will have cut completely through the casing wall. The following longer gage watermelon mill serves to dress the window 74 and remove any burrs or any other projections which might impede smooth passage of other tools through the window 74. Milling should be continued until the new hole 75 extends for 5–10 feet outward, after which the milling is stopped and the hole circulated for a while to remove all cuttings and other particles that may remain. Then the drilling tool string is removed from the well as the coiled tubing 17 is wound back onto the reel 8.

During the milling of the window 79, it may be desirable to use several motors 71 having different bent housing angles 0. For example the upper part of the window 74 which includes the initial opening through the casing 11 can be milled with a more severe bend angle of about 3°. An intermediate part of the window 74 can be milled using a lower bend angle of 1.83°, while the lower portion thereof may be milled using a small bend angle of 0.38°. The watermelon mill (not shown) is used to dress the window 70 by pulling it up and down there through several times before removing the drilling tool string from the well 10. Of course to change bend angles the tool string must be retrieved to substitute bent housings.

The borehole 75 can be extended in a directional manner using a drill string and a mud motor having a bent housing, and a rotary drill bit as described above. Alternatively, longitudinally spaced stabilizers on the drill string can be used to cause hole deviation because of the pendulum effect. Although various sizes, angles, lengths, etc. are given throughout the description, it will be recognized that these values are only exemplary and that other values can be used as circumstances require. Although coiled tubing 17 has been disclosed as the running string and is preferred, various ones of the process steps could be carried out using tubing and/or drill pipe as the running string.

It now will be recognized that new and improved methods and systems have been disclosed which enable a window to be formed in a casing off a whipstock that is set in a cement plug, so that a new borehole can be drilled outside the casing. Certain changes or modifications may be made in the disclosed embodiment without departing from the inventive concepts involved. For example where the longitudinal axis of the casing is sufficiently inclined with respect to vertical, the hole in the cement plug can be drilled without using a bend housing or employing orientation, by employing gravity to cause the mill to drill to and then along the low side of the casing bore. Thus it is the aim of the appended claims to cover all such changes and modifications falling within the true spirit and scope of the present invention.

What is claimed is:

1. A method for forming a window through a wall of a well casing below the lower end of a production pipe suspended therein, said window allowing a new borehole to be drilled outside said casing; comprising the steps of: forming an elongated cement plug in said casing below the lower end of said production pipe; drilling a hole in said cement plug which curves to a side wall of the casing and then extends longitudinally along said side wall; setting a whipstock having a deflection surface in said hole with said deflection surface facing an inner wall surface of the casing; and milling an elongated window through the wall of said casing using said deflector surface as a guiding cam.

2. The method of claim 1 wherein said drilling step is carried out using a rotating milling cutter having an axis of rotation at an angle to a longitudinal axis of the casing.

3. The method of claim 2 including the further step of angularly orienting said axis of rotation so that said hole curves in a selected azimuthal direction.

4. The method of claim 3 wherein said orienting step includes providing an additional correction angle which offsets the tendency of said milling cutter to walk counterclockwise, as viewed from above, on account of a clockwise direction of rotation thereof.

5. The method of claim 1 including the further step of anchoring said whipstock against downward and rotational movement in said hole.

6. The method of claim 3 including the further steps of making measurements of the angular orientation of said axis with respect to a reference, and transmitting signals to the surface representative of said measurements; and adjusting the angular orientation of said axis of rotation to a desired value.

7. The method of claim 6 wherein said adjusting step is carried out by providing flow rate change response index means for rotating said axis through a predetermined angle, and selectively changing a flow rate to achieve said angular orientation.

8. A method of forming a window through a wall of a well casing below the lower end of a production pipe suspended therein, said window allowing a new borehole to be drilled outside said casing, comprising the steps of: using a work string of pipe to place a column of cement in the casing below the lower end of the production pipe, the upper end of said cement column being located adjacent said lower end, said cement when hardened providing a plug in the casing; lowering a drilling motor having a milling cutter and a bent housing through said production pipe on a running string until said cutter is over the upper end of said cement plug, said bent housing providing said cutter with a rotation axis that is inclined with respect to a longitudinal axis of said motor; angularly orienting said motor and said bent housing so that said rotation axis faces in a selected azimuthal direction; operating said motor to cause said cutter to drill a hole in said cement plug having a curved upper section that extends from a location centrally of said upper end to a location adjacent an inner wall surface of the casing, and a straight lower section that extends longitudinally along said wall surface; removing said drilling motor and said milling cutter from the well; lowering a whipstock having an inclined deflector surface through the production string on a running string; angularly orienting said whipstock so that said deflection surface faces said casing wall surface; lower said whipstock into said lower section of said hole and anchoring said whipstock therein; again lowering a motor having a milling cutter and a bent housing through said production string on a running string; again angularly orienting said motor and bent housing so that said axis of rotation extends toward said casing wall surface; lowering said motor and bent housing until said milling cutter engages said deflector surface; operating and lowering said motor to mill an elongated window through said wall surface of said casing with said cutter being cammed outward and guided by said deflection surface; and removing said motor and running string from the well.

9. The method of claim 8 including the further step of making measurements of a toolface angle provided by said rotation axis and transmitting signals representative thereof to the surface for processing and display.

10. The method of claim 9 wherein said orienting step is performed by providing indexing means responsive to changes in a flow rate of drilling fluids in said running string, said indexing means causing rotation of said motor means and bent housing through a predetermined angle in response to such changes; and changing said flow rate to operate said indexing means.

11. The method of claim 10 wherein said measurement making step includes measuring fight angle components of the earth's gravity field; and determining from the respective values of said components the azimuthal direction of said axis of rotation, and toolface angle.

12. The method of claim 11 including the additional step of making an initial correction of the value of said toolface angle to accommodate the tendency of said milling cutter to walk as it forms said lower section of said hole.

13. A combination of apparatus for use in forming a window at a selected azimuthal direction through the wall of a well casing to permit a new borehole to be drilled outside the casing, said casing having a production string of tubing disposed therein, comprising: means forming an elongated cement plug in said casing below the lower end of said production string; bore drilling means sized to be lowered through said production string on a running string and including a rotary mill cutter having an axis of rotation that is inclined with respect to the longitudinal axis of the casing so that said cutter will drill a hole into said cement plug having an upper section that curves outward until it reaches an inner wall surface of the casing, and a lower section that extends longitudinally therealong; means for making measurements of the angular orientation of said axis with respect to a reference and transmitting signals representative thereof to the surface; and means for adjusting said angular orientation prior to drilling said upper section of said hole so that said lower section extends along a selected side of said casing where said window is to be formed.

14. The combination of claim 13 wherein said bore drilling means includes a downhole motor responsive to the flow of drilling fluids pumped down the running string for rotating said mill cutter, said motor including a housing constructed and arranged to provide a bend angle that inclines said axis of rotation.

15. The combination of claim 14 wherein said angular orientation measuring means includes accelerometer means for measuring components of the earth's gravity field from which the azimuthal direction of said axis of rotation, and toolface angle, can be determined.

16. The combination of claim 14 wherein said adjusting means includes angular indexing means responsive to drilling fluid flow rate changes for successively rotating said motor and bend housing through a selected angle during each flow rate change.

17. A combination of apparatus components for use in forming a window at a selected azimuthal direction through the wall of a well casing to permit a new borehole to be drilled outside the casing, said casing having a production string of tubing disposed therein; comprising: an elongated cement plug formed in said casing primarily below the lower end of the production string, said plug having a hole drilled therein including an upper section that curves outward until it reaches an inner wall surface of the casing, and a lower section that extends longitudinally along said inner wall surface, whipstock means set in said lower section of said hole, said whipstock means having an inclined deflection surface facing said inner wall surface of the casing and arranged to guide a rotary milling cutter and force it progressively outward as it mills a window through said inner wall surface; means for making measurements of the angular orientation of said deflection surface with respect to a reference and for transmitting signals representative thereof to the surface; and means for adjusting said angular orientation prior to setting said whipstock means so that said deflector surface faces in a selected azimuthal direction.

18. The combination of claim 17 further including means for releasably attaching said measuring means and adjusting means to said whipstock means so that said measuring and adjusting means can be retrieved from the well after orienting and setting of said whipstock means.

19. The combination of claim 17 wherein said angular orientation measuring means includes accelerometer means for measuring components of the earth's gravity field from which the azimuthal direction at which said deflector surface is facing can be determined.

20. The combination of claim 17 wherein said adjusting means angular indexing means responsive to drilling fluid flow rate changes for successively rotating said whipstock means through a discrete angle during each flow rate change.

21. Apparatus for use in forming a window through the wall of a well casing to permit a new borehole to be drilled outside the casing, comprising: an elongated cement plug formed in said casing; a bore formed in said plug, said bore having an upper section that curves outward until it reaches an inner wall surface of said casing, and a lower section that extends longitudinally along said inner wall surface; whipstock means set in said lower section of said hole, said whipstock means having an inclined deflection surface facing said inner wall surface and arranged to guide a rotary milling cutter and force it progressively outward as said cutter mills an elongated window through said inner wall surface.

22. The apparatus of claim 21 wherein said whipstock means includes normally retracted anchor means adapted to be extended into engagement with wall surfaces of said lower bore section to prevent downward and rotational movement of said whipstock means therein.

* * * * *